US008424349B2

(12) United States Patent
Marcelle et al.

(10) Patent No.: US 8,424,349 B2
(45) Date of Patent: Apr. 23, 2013

(54) KEY CYLINDER LOCK ARRANGEMENTS

(75) Inventors: Jesse A. Marcelle, Muskego, WI (US); Dean A. Paulson, Oak Creek, WI (US)

(73) Assignee: Master Lock Company LLC, Oak Creek, WI (US)

( * ) Notice: Subject to any disclaimer, the term of this patent is extended or adjusted under 35 U.S.C. 154(b) by 250 days.

(21) Appl. No.: 12/811,262

(22) PCT Filed: Jan. 20, 2009

(86) PCT No.: PCT/US2009/031428

§ 371 (c)(1),
(2), (4) Date: Sep. 9, 2010

(87) PCT Pub. No.: WO2009/092079

PCT Pub. Date: Jul. 23, 2009

(65) Prior Publication Data

US 2011/0011139 A1 Jan. 20, 2011

Related U.S. Application Data

(60) Provisional application No. 61/022,083, filed on Jan. 18, 2008.

(51) Int. Cl.
*E05B 25/00* (2006.01)

(52) U.S. Cl.
USPC ..... 70/383; 70/338; 70/492; 70/496; 70/373; 70/377

(58) Field of Classification Search ..... 70/492, 70/377, 382–385, 406, 367, 370, 371, 373, 70/495, 496
See application file for complete search history.

(56) References Cited

U.S. PATENT DOCUMENTS

| | | | |
|---|---|---|---|
| 2,895,323 | A | 7/1959 | Kennedy |
| 3,059,462 | A | 11/1962 | Check |
| 3,125,878 | A | 3/1964 | Gutman |
| 3,255,620 | A | 6/1966 | Quillen |
| 3,585,826 | A | 6/1971 | Merurio |

(Continued)

FOREIGN PATENT DOCUMENTS

CN 2730298 Y 11/2005

OTHER PUBLICATIONS

Preliminary Report on Patentability and Written Opinion International Application No. PCT/US09/31428, dated Jul. 20, 2010.

(Continued)

*Primary Examiner* — Suzanne Barrett
(74) *Attorney, Agent, or Firm* — Calfee, Halter & Griswold LLP

(57) ABSTRACT

A recodeable lock includes a housing, a cylinder plug, a plurality of wafer tumblers, and a sidebar coupled with the cylinder plug. The sidebar is assembled with a plurality of code blocks and a codebar releasably securing the code blocks to the sidebar. A liftbar is disposed in the housing radially outward of the cylinder plug and is configured to selectively engage a radially outward extending appendage of the codebar when the cylinder plug and sidebar are rotated to a recoding orientation, to release the code blocks from the sidebar. The housing includes a circumferential track axially positioned to receive the appendage of the codebar to permit greater than 180 degree rotation of the cylinder plug and sidebar with respect to the housing.

18 Claims, 15 Drawing Sheets

U.S. PATENT DOCUMENTS

| | | | | |
|---|---|---|---|---|
| 3,665,741 | A | 5/1972 | Holst | |
| 3,983,728 | A | 10/1976 | Phillips | |
| 3,999,413 | A | 12/1976 | Raymond et al. | |
| 4,069,694 | A | 1/1978 | Raymond et al. | |
| 4,233,828 | A | 11/1980 | Dauenbaugh | |
| 4,376,382 | A | 3/1983 | Raymond et al. | |
| 4,712,402 | A | 12/1987 | Monahan | |
| 4,717,816 | A | 1/1988 | Raymond et al. | |
| 4,729,231 | A | 3/1988 | Wu | |
| 4,741,188 | A | 5/1988 | Smith | |
| 4,850,210 | A | 7/1989 | Adler et al. | |
| 4,912,953 | A | 4/1990 | Wobig | |
| 4,966,021 | A | 10/1990 | Boag | |
| 5,836,187 | A | 11/1998 | Janssen et al. | |
| 6,119,455 | A | 9/2000 | Hammer et al. | |
| 6,263,713 | B1 | 7/2001 | Fantl | |
| 6,755,063 | B2 | 6/2004 | Takadama | |
| 6,860,131 | B2 | 3/2005 | Armstrong et al. | |
| 6,862,909 | B2 | 3/2005 | Armstrong et al. | |
| 6,871,520 | B2 | 3/2005 | Armstrong et al. | |
| 6,951,123 | B2 | 10/2005 | Chong | |
| 6,959,569 | B2 | 11/2005 | Strader et al. | |
| 6,968,717 | B2 | 11/2005 | Suzuki et al. | |
| 6,973,813 | B2 | 12/2005 | Erdely | |
| 7,007,528 | B2 | 3/2006 | Chong et al. | |
| 7,114,357 | B2 | 10/2006 | Armstrong et al. | |
| 7,117,701 | B2 | 10/2006 | Armstrong et al. | |
| 7,162,901 | B2 | 1/2007 | William | |
| 7,213,429 | B2 | 5/2007 | Armstrong et al. | |
| 7,234,331 | B2 | 6/2007 | Armstrong et al. | |
| 7,308,811 | B2 | 12/2007 | Armstrong et al. | |
| 7,322,219 | B2 | 1/2008 | Armstrong et al. | |
| 7,434,431 | B2 | 10/2008 | Armstrong et al. | |
| 7,634,930 | B2 * | 12/2009 | Boesel et al. | 70/383 |
| 7,980,104 | B1 * | 7/2011 | Huang | 70/338 |
| 8,096,155 | B2 * | 1/2012 | Williams | 70/493 |
| 2002/0189307 | A1 | 12/2002 | Gokcebay et al. | |
| 2003/0089149 | A1 * | 5/2003 | Suzuki et al. | 70/492 |
| 2003/0159483 | A1 | 8/2003 | Kondratuk et al. | |
| 2005/0172687 | A1 | 8/2005 | Segien et al. | |
| 2006/0059965 | A1 | 3/2006 | Benstead | |
| 2006/0101880 | A1 | 5/2006 | Ward-Dolkas et al. | |
| 2006/0112748 | A1 | 6/2006 | Benstead | |
| 2006/0117822 | A1 | 6/2006 | Boesel et al. | |
| 2006/0260371 | A1 | 11/2006 | William | |
| 2008/0314106 | A1 | 12/2008 | Mathachan | |

OTHER PUBLICATIONS

English Text of Office Action from Chinese Patent Application No. 200980102345.4, dated Jul. 26, 2012.

* cited by examiner

KEY CYLINDER LOCK ARRANGEMENTS

CROSS-REFERENCE TO RELATED APPLICATION

This application claims the benefit of U.S. Provisional Patent Application Ser. No. 61/022,083, entitled "KEY CYLINDER LOCK ARRANGEMENTS" and filed Jan. 18, 2008, the entire contents of which are incorporated herein by reference, to the extent that they are not conflicting with the present application.

BACKGROUND

Key cylinder lock sets are well known and commonly used in many applications, including, for example, padlocks, residential and commercial entry doors, and vehicle door applications. It is often desirable to change or "re-key" a lock to prevent access to a locked structure or enclosure by the holder of an authorized key, for example, when a key is lost or stolen, or when access (such as by a former employee or resident) is no longer necessary or desirable. While re-keying some key cylinder locks requires disassembly of the lock and removal of the cylinder plug from the cylinder body to replace or rearrange tumblers, other key cylinder lock sets have been developed to include recoding or re-keying mechanisms that allow a user to alter the locking mechanism to accept a different authorized key. For example, a recodeable key cylinder lock arrangement may be configured such that, upon insertion of an authorized key and selective movement of the locking mechanism to a recoding condition (such as by rotation of the key to a recoding orientation and/or insertion of a tool into the lock cylinder), insertion of a different key may cause the locking mechanism to become configured to be unlocked by the different key.

In one embodiment, a recodeable key cylinder lock may include a sidebar configured to be movable from a locked condition to an unlocked condition to disengage a locking portion of the sidebar from a corresponding locking portion of the housing for rotation of the cylinder plug. Insertion of an authorized key moves a series of wafer tumblers to unlocking positions, in which code blocks (disposed in corresponding unlocking positions) assembled with the sidebar engage notches in the wafer tumblers to allow the sidebar to move to the unlocked condition. Rotation of the cylinder plug to a recoding orientation allows a liftbar to engage an appendage of a codebar for release of the code blocks from the sidebar, such that the code blocks may be moved to new unlocking positions corresponding to a coded surface of a new authorized key.

One such exemplary embodiment of a key cylinder lock set configured to allow for this type of recoding operation is described in U.S. patent application Ser. No. 11/244,881 (Publication No. 2006/0117822) (the "'881 application"), entitled LOCK APPARATUS AND METHOD, the entire disclosure of which is incorporated herein by reference, to the extent that it is not conflicting with the present application. In the exemplary embodiment (illustrated in FIGS. 36A-36I of the '881 application, and corresponding FIGS. 1A-1I herein), a recodeable lock 929 includes a cylinder plug 930 configured to receive an authorized key 901 (FIG. 1A) for engaging a series of slidable wafer tumblers 923 (FIGS. 1B, 1C, and 1I) to align notches 935 disposed on the wafer tumblers 923 with corresponding protrusions 910 (FIG. 1G) associated with a sidebar 984 (FIGS. 1B and 1C). Upon alignment of the notches 935 and protrusions 910, the sidebar 984 becomes movable (by flexible arm 976 on sleeve 920) to disengage from a notch 916 (FIG. 1B) of the housing 914, thereby allowing the cylinder plug 930 to be rotated to an unlocked orientation. The protrusions 910 are disposed on a series of code blocks 908 (FIGS. 1B and 1G-1I) positioned in channels 983 of the sidebar 984 and are each secured at a fixed distance from the key axis by serrations 909 on the code blocks 908 that interlock with corresponding serrations 951 on posts 950 of a codebar 946 (FIGS. 1D and 1G) that is received in apertures 977 of the sidebar 984 (FIG. 1C).

To modify or "recode" the locking mechanism to accept a different key for unlocking the lock, an authorized key is inserted into the key cylinder plug 930 to align the wafer notches 935 with the code block protrusions 910 to allow the sidebar 984 to disengage the notch 916 in the cylinder housing 914 to permit rotation of the plug 930 and sidebar 984 about the key axis (by turning the key). When the cylinder plug 930 and sidebar 984 are rotated to a recoding orientation (FIG. 1D), an appendage 945 of the codebar 946 engages a catch 995 of a liftbar 985. A tool 905 may then be inserted into an access hole 919 of the housing 914 to move a pivot lever 991 engaged with the liftbar 985 (FIG. 1E), such that the liftbar 985 moves the codebar posts 950 out of engagement with the code blocks 908, allowing the code blocks 908 to move radially with respect to the key axis (along channels 983 in the sidebar 984). Upon insertion of a new key (which the user intends to use as the new authorized key), the coded surface of the new key moves each of the code blocks 908 (which are still engaged with corresponding wafer tumblers 923) against corresponding springs 924. Subsequent withdrawal of the tool 905 allows a biasing member 966 to return the codebar posts 950 to engagement with the code blocks 908, thereby securing the code blocks 908 in new radial positions with respect to the key axis. Consequently, the new positions correspond to the coded surface of the new key. Thereafter, insertion of the new key in the cylinder plug 930 aligns the wafer notches 935 with the code block protrusions 910 for disengagement of the sidebar 984 from the housing notch 916 and rotation of the cylinder plug 930 to either of the unlocked and recoding orientations. Also, to ensure that the key is fully inserted in the lock when recoding, an anti-rotation block 980 (FIGS. 1B and 1C) is provided in the cylinder plug 930 for interlocking engagement with the cylinder housing 914, with the anti-rotation block 980 being configured to disengage from the housing 914 upon full insertion of the key. The anti-rotation block 980 includes a flex arm 981 that biases the block 980 back to interlocking engagement with the housing 914 upon withdrawal of the key.

In the illustrated embodiment of the '881 application, the liftbar 985 and pivot lever 991 are disposed in a holding block 917 (FIGS. 1D and 1E) extending from an outer cylindrical surface of the housing 914 (and may, but need not, be integral with the housing 914). A spring cover 921, from which the biasing member 966 extends, is secured to the holding block 917 to retain the liftbar 985 and pivot lever 991. To allow for engagement of the codebar appendage 945 with the liftbar catch 995, a slot or channel 913 is provided in the housing 914 (FIG. 1B), through which the codebar appendage 945 may travel as the cylinder plug 930 and sidebar 984 are rotated between locked, unlocked, and recoding orientations. A notch in the holding block 917 (FIG. 1B) permits the appendage 945 to enter the holding block for engagement with the liftbar catch 995 in the recoding orientation. However, as the channel 913 is unable to extend around the entire circumference of the housing 914, travel of the codebar appendage 945 and rotation of the cylinder plug 930 and sidebar 984 is limited to less than 180.degree.. This limitation may restrict the applications in which the recodeable key cylinder lock set may be used, as some applications require upwards of 360.degree. rotation of the key cylinder plug to operate the latch with which the key cylinder is being used.

SUMMARY

According to an inventive aspect of the present application, a recodeable key cylinder locking arrangement may include a cylinder housing configured to permit increased rotation (e.g., greater than 180° rotation) of a cylinder plug having a codebar with an appendage that extends radially outward of the cylinder plug diameter, for example, to engage a liftbar for adjustment of code blocks assembled with the sidebar. In one embodiment, a cylinder housing may be provided with a circumferential wall having an circumferential track axially positioned to receive the appendage of the codebar for rotation of the cylinder plug and sidebar.

Accordingly, in one embodiment, a recodeable lock includes a housing, a cylinder plug, a plurality of wafer tumblers, and a sidebar coupled with the cylinder plug. The sidebar is assembled with a plurality of code blocks and a codebar releasably securing the code blocks to the sidebar. A liftbar is disposed in the housing radially outward of the cylinder plug and is configured to selectively engage a radially outward extending appendage of the codebar when the cylinder plug and sidebar are rotated to a recoding orientation, to release the code blocks from the sidebar. The housing includes a circumferential track axially positioned to receive the appendage of the codebar to permit greater than 180 degree rotation of the cylinder plug and sidebar with respect to the housing.

BRIEF DESCRIPTION OF THE DRAWINGS

Features and advantages of the invention will become apparent from the following detailed description made with reference to the drawings, wherein.

DETAILED DESCRIPTION

Figure 1A:
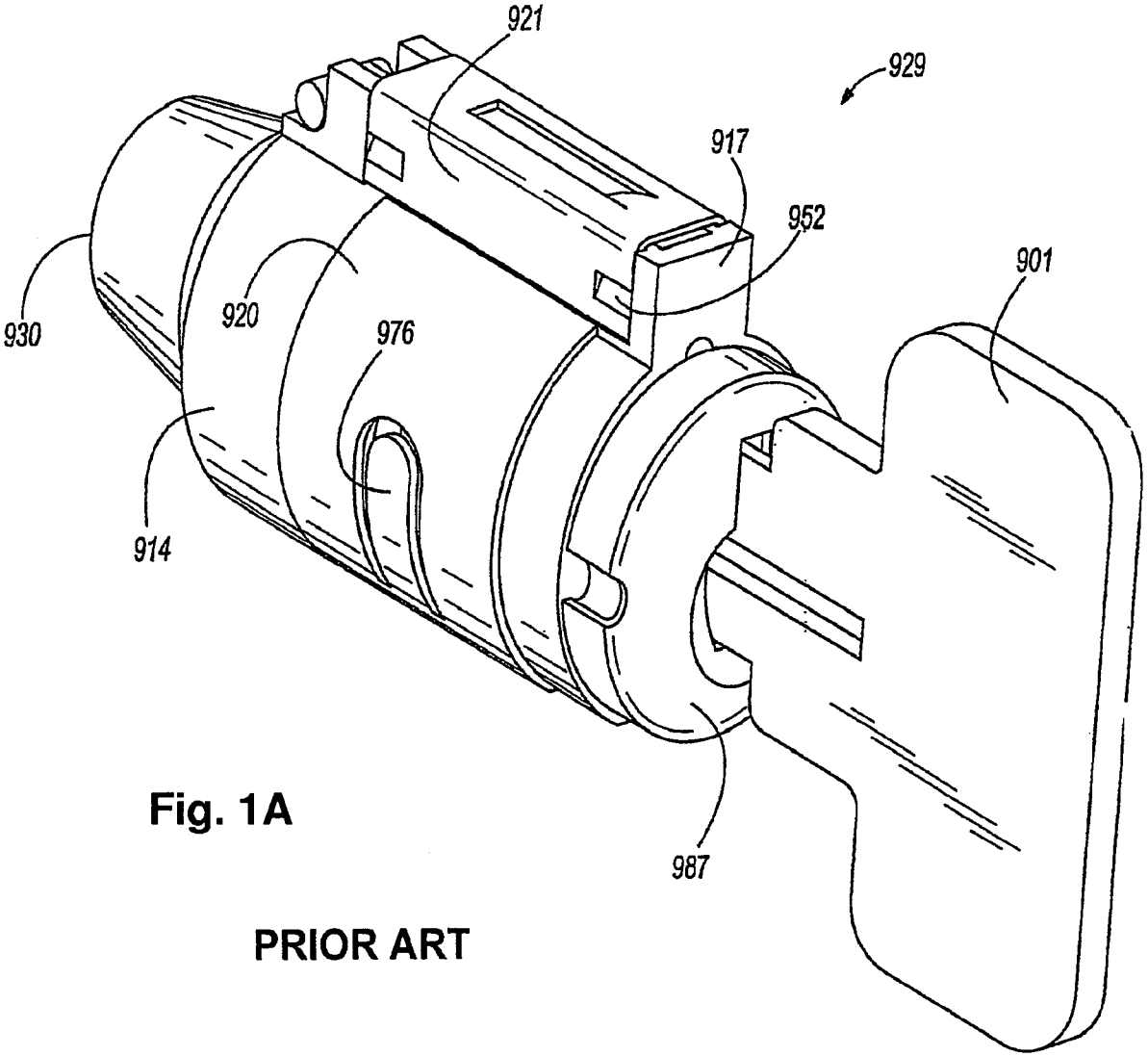
Fig. 1A PRIOR ART
FIG. 1A illustrates a perspective view of a recodeable key cylinder lock.
Figure 1B:
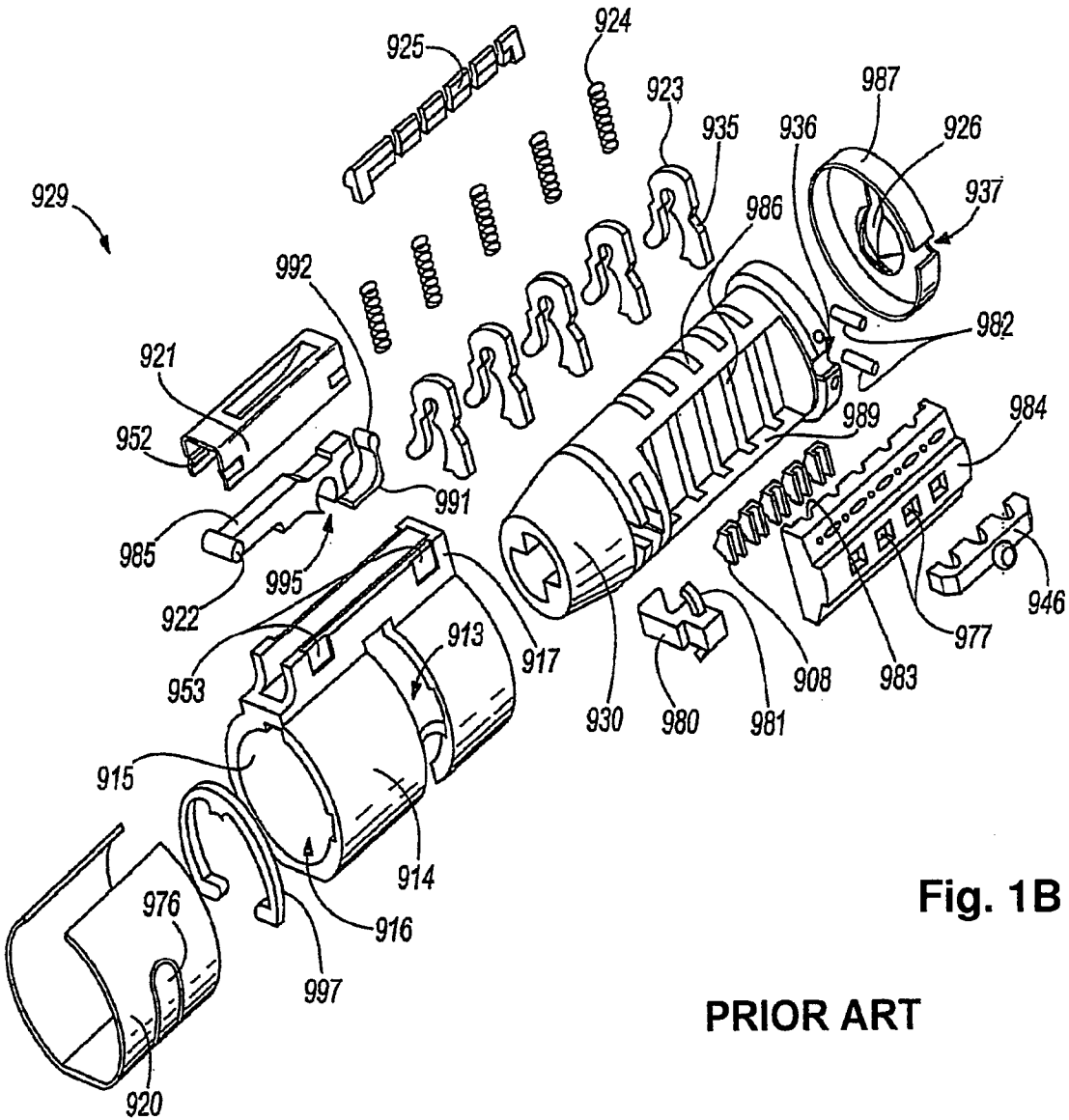
Fig. 1B PRIOR ART
FIG. 1B illustrates an exploded view of the recodeable key cylinder lock of FIG. 1A.
Figure 1C:
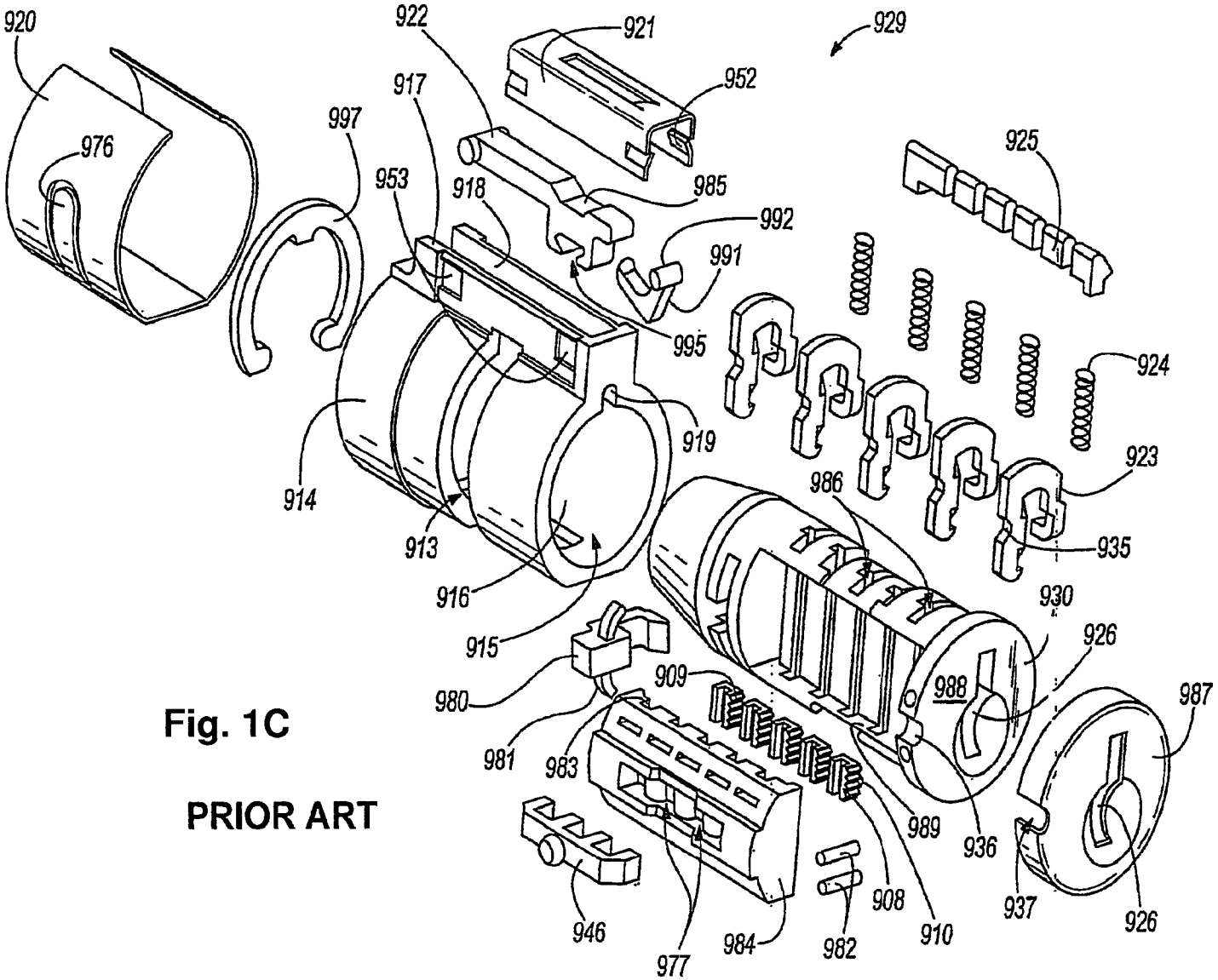
Fig. 1C PRIOR ART
FIG. 1C illustrates another exploded view of the recodeable key cylinder lock of FIG. 1A.
Figure 1D:
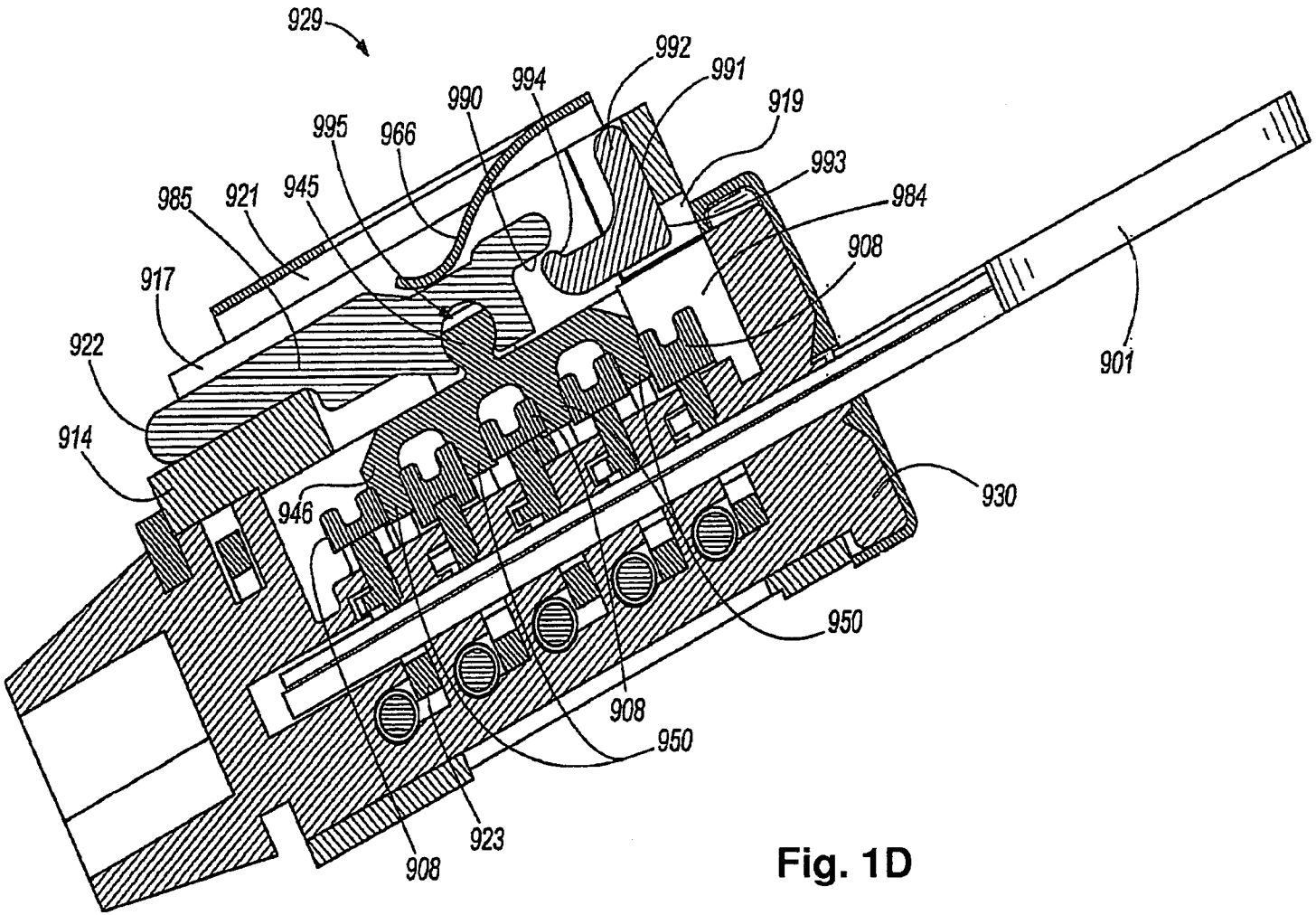
Fig. 1D PRIOR ART
FIG. 1D illustrates a cross-sectional view of the recodeable key cylinder lock of FIG. 1A.
Figure 1E:
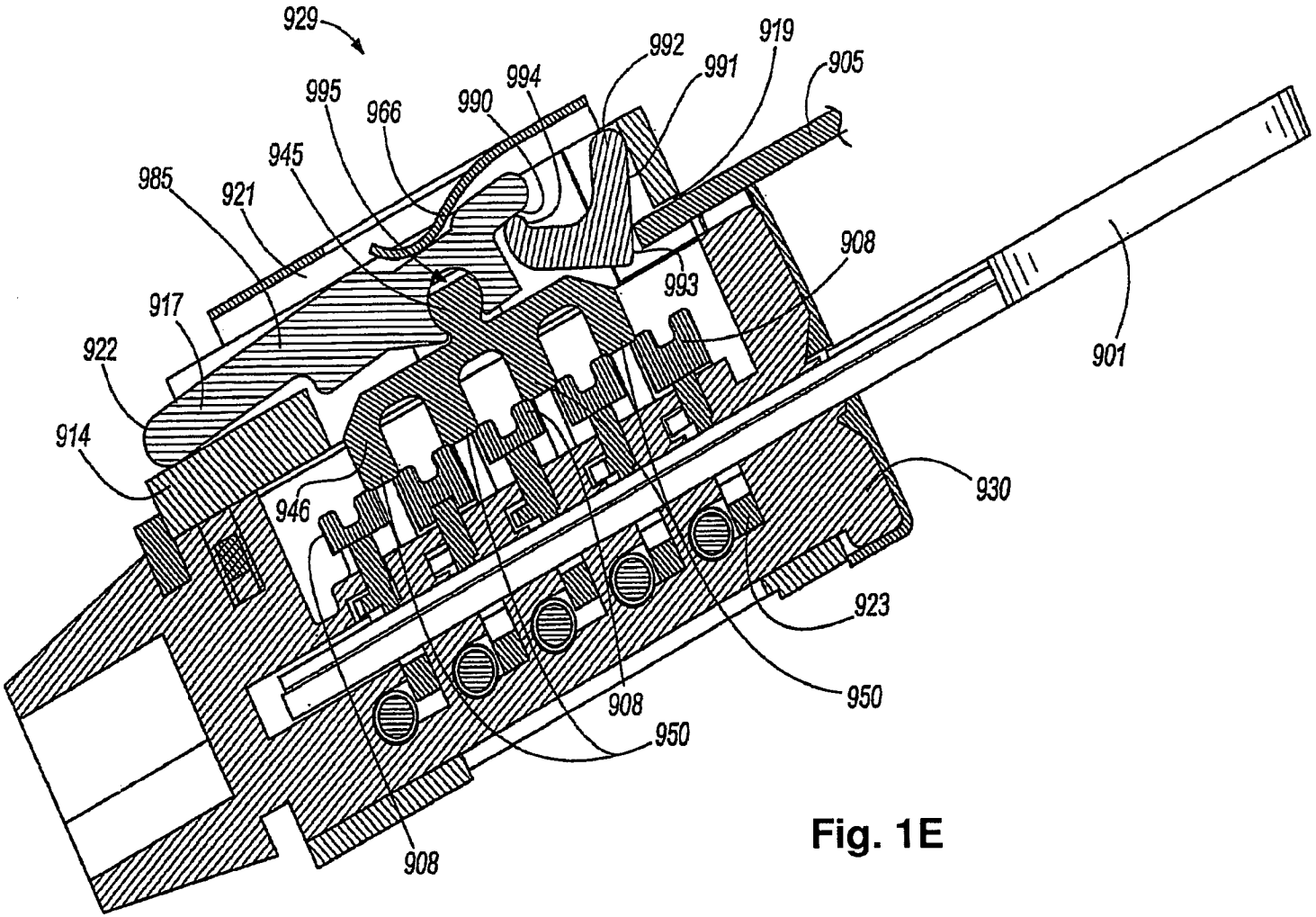
Fig. 1E PRIOR ART
FIG. 1E illustrates another cross-sectional view of the recodeable key cylinder lock of FIG. 1A.
Figure 1F:
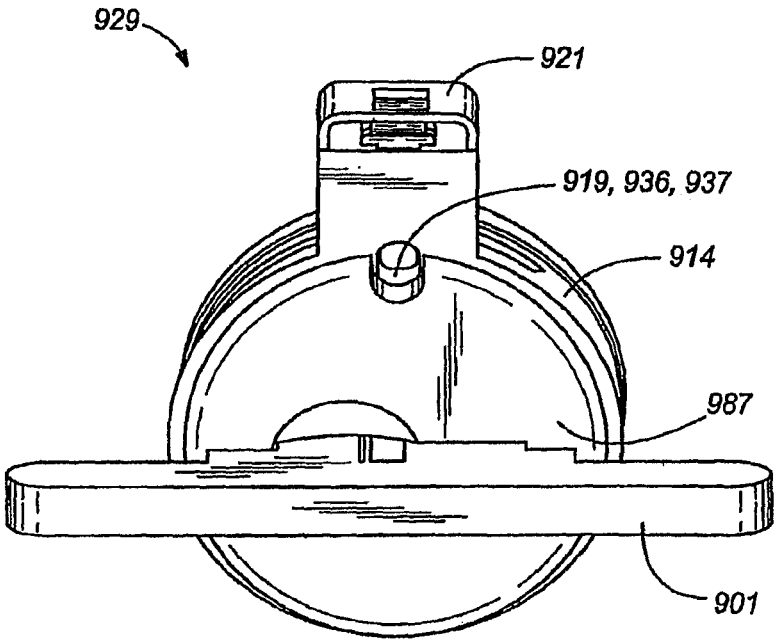
Fig. 1F PRIOR ART
FIG. 1F illustrates a front perspective view of the recodeable key cylinder lock of FIG. 1A.
Figure 1G:
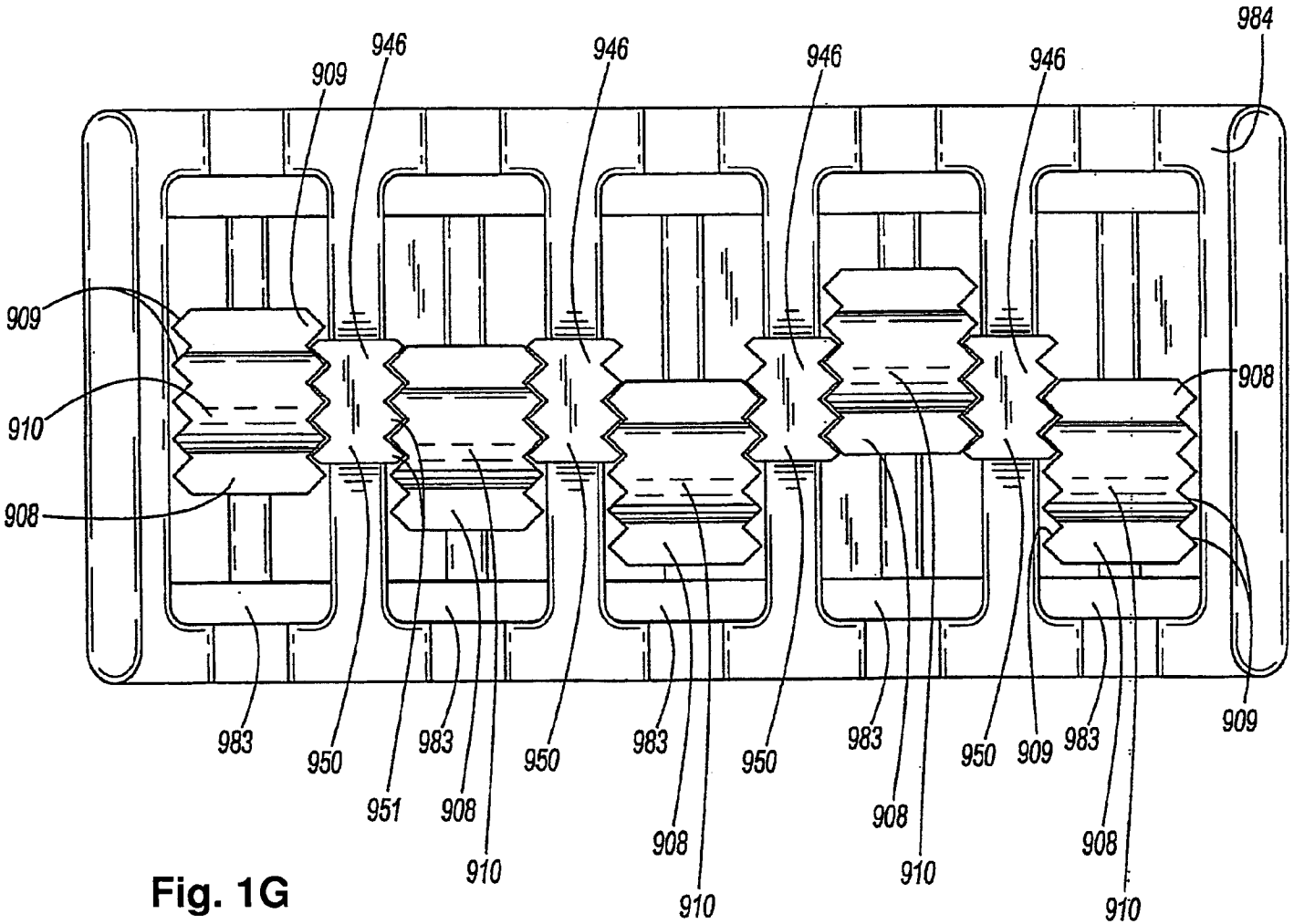
Fig. 1G PRIOR ART
FIG. 1G illustrates a bottom view of a portion of the recodeable key cylinder lock of FIG. 1A.
Figure 1H:
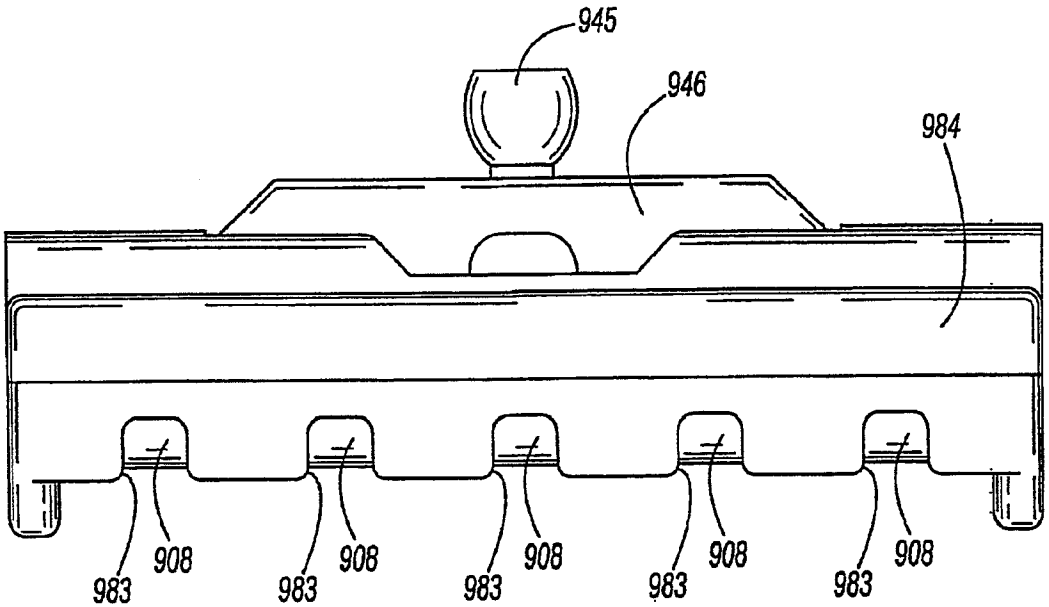
Fig. 1H PRIOR ART
FIG. 1H illustrates a side view of a portion of the recodeable key cylinder lock of FIG. 1A.
Figure 1I:
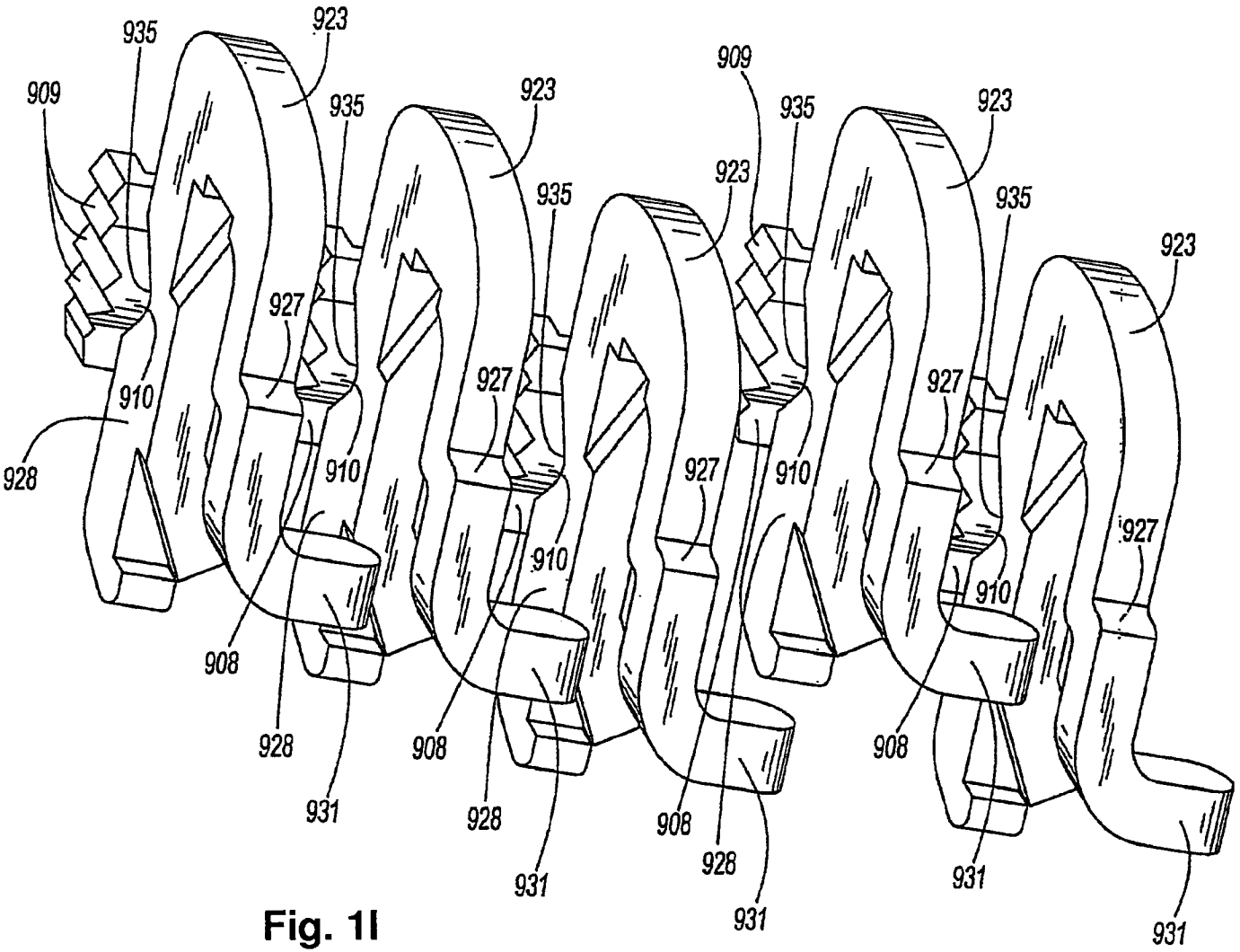
Fig. 1I PRIOR ART
FIG. 1I illustrates a perspective view of a portion of the recodeable key cylinder lock of FIG. 1A.

This Detailed Description merely describes embodiments of the present application and is not intended to limit the scope of the claims in any way. Indeed, the invention as described in the specification and claims is broader than and unlimited by the preferred embodiments, and the terms used in the claims have their full ordinary meaning.

The present application contemplates a recodeable key cylinder lock having a lock housing adapted to permit increased rotation of the cylinder plug and recodeable locking mechanism, for use with locking arrangements requiring extended rotation of the cylinder plug (e.g., greater than 180° rotation, 360° rotation, or greater than 360° rotation). In one embodiment, a recodeable lock includes a housing having a recodeable locking mechanism with a radially outward extending portion or appendage that is engaged by a liftbar within the housing to permit "re-coding" of the lock, to allow the lock to be unlocked by a new and different authorized key. According to an inventive aspect of the present application, the housing may be provided with a circumferential track that is axially aligned with the appendage to receive the appendage during rotation of the unlocked cylinder plug, thereby allowing greater rotation of the cylinder plug. In one such embodiment, a circumferential track may extend around the entire circumference of the housing to permit 360° rotation of the cylinder plug. While the circumferential track may take one or more of several suitable forms, in one embodiment, the circumferential track includes a first portion formed by a slot extending through a peripheral wall of the housing, and a second portion formed by a recess or pocket disposed on an inner periphery of the housing.

FIGS. 2A-7 illustrate various views of an exemplary lock assembly 100 having a recodeable key cylinder lock 129 configured to allow for 360.degree. rotation of the cylinder plug 130 within the housing 114 upon insertion and rotation of an authorized key. The housing 114 includes a circumferential wall 111 having an inner circumferential recess or pocket 112 (FIG. 5) sized and positioned to receive an appendage 145 of a locking mechanism 120 extending radially outward of the cylinder plug diameter (defined by the cylinder plug 130 and the locking mechanism 120). The radially extending appendage 145 may engage a liftbar 185 radially outward of the cylinder plug diameter, while allowing for rotation of the cylinder plug 130 and locking mechanism 120. The pocket 112 is axially aligned with a circumferential slot or channel 113, which together fowl a circumferential track extending around the entire circumference of the housing 114 to allow for 360.degree. rotation of the cylinder plug 130 and locking mechanism 120, as they provide clearance for free, full rotation of the appendage 145. While another embodiment may include a gap or channel around the entire periphery of the housing to similarly allow for 360.degree. rotation of the cylinder plug and sidebar (not shown), the lack of reinforcing material between portions of the cylinder housing may affect durability of the lock, and may leave the locking arrangement susceptible to tampering. As shown, the housing may be provided with an outer circumferential band of material or rib 107 (FIGS. 3-4) axially and circumferentially aligned with the pocket 112 to provided added strength and durability. This rib 107 may also facilitate pinning or staking the housing 114 into the lock assembly, for example, by aligning pins or fasteners with the end shoulders of the rib 107, to impede unauthorized removal of the cylinder lock (for example, by drilling). A nub 106 extending from the rib 107 and a complementary shaped cutout 104 on the spring cover 121 assist with proper alignment and orientation of the spring cover 121 on the holding block 117.

Figure 2A:
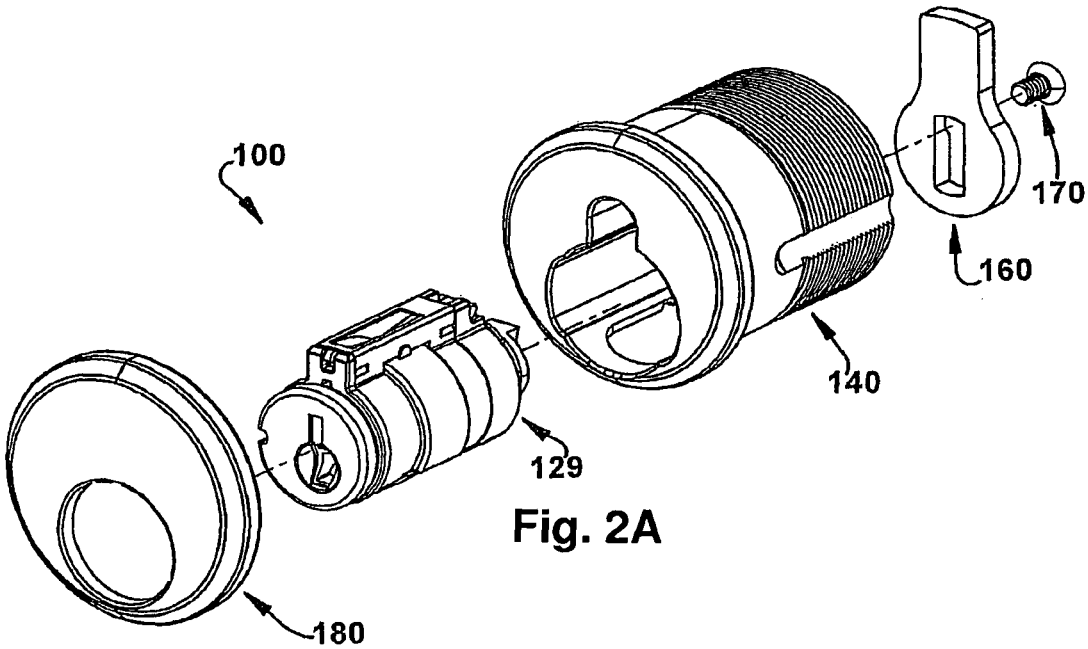
FIG. 2A illustrates a front right exploded perspective view of a lock assembly with a recodeable key cylinder lock.
Figure 2B:
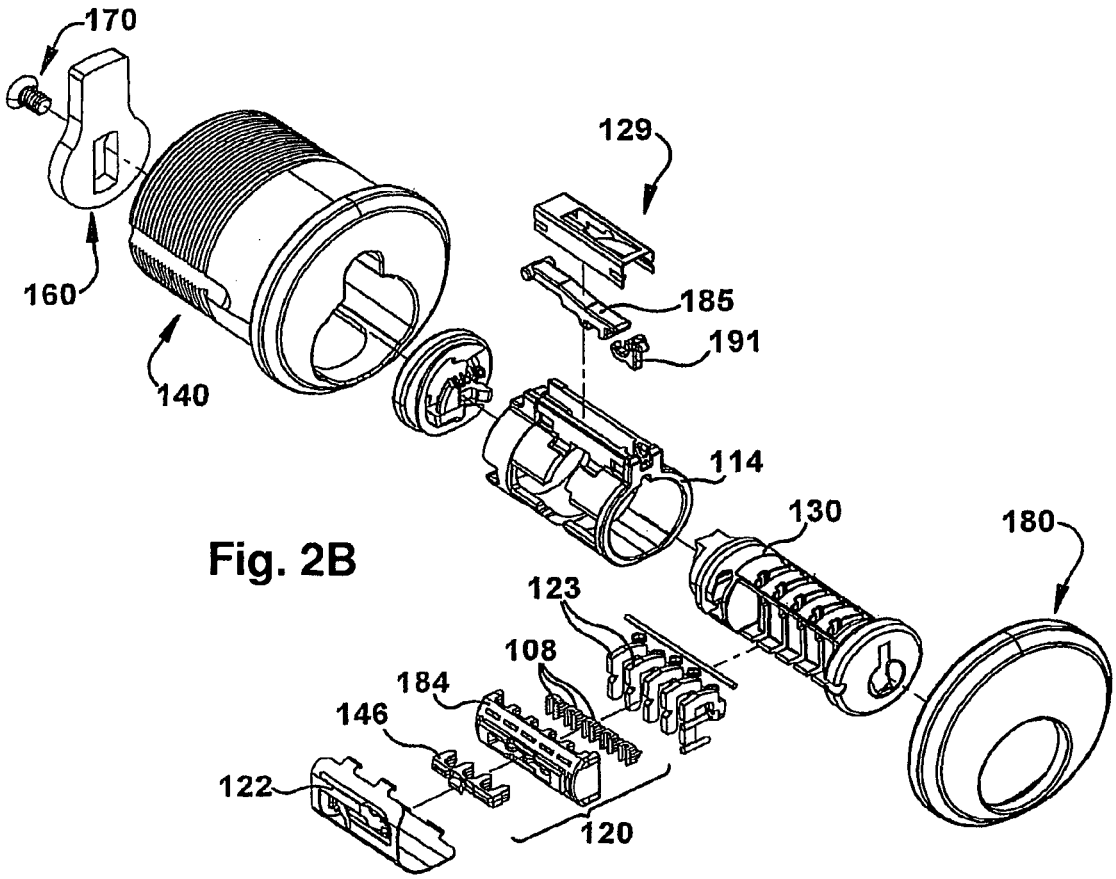
FIG. 2B illustrates a front left exploded perspective view of the lock assembly of FIG. 2A.
Figure 3:
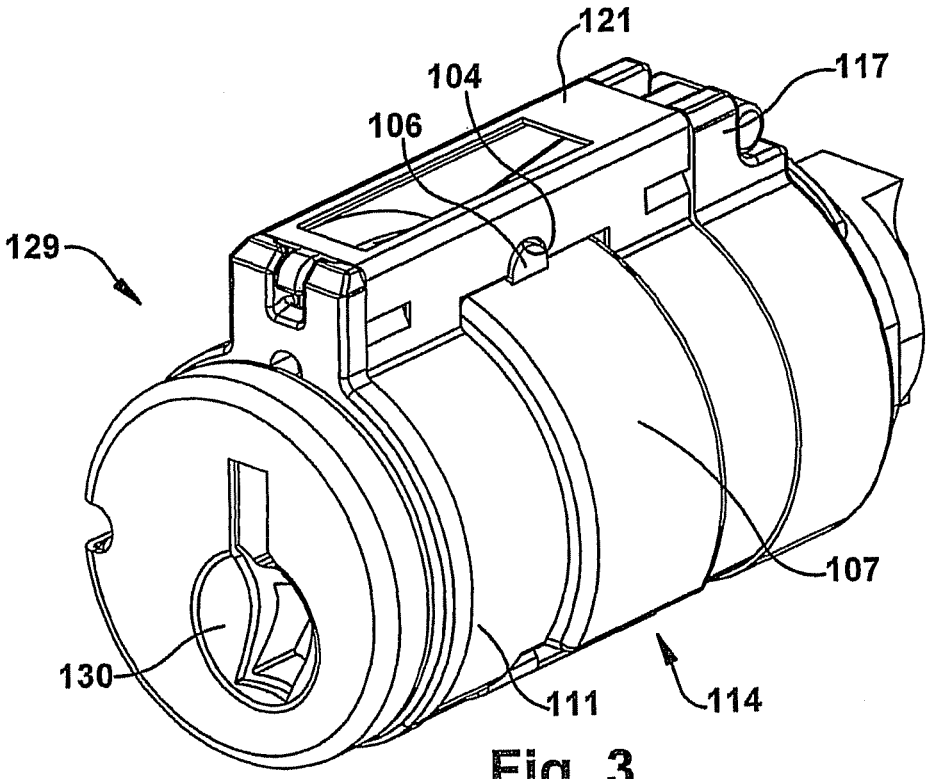
FIG. 3 illustrates a front right perspective view of the recodeable key cylinder lock of the lock assembly of FIG. 2A.
Figure 4:
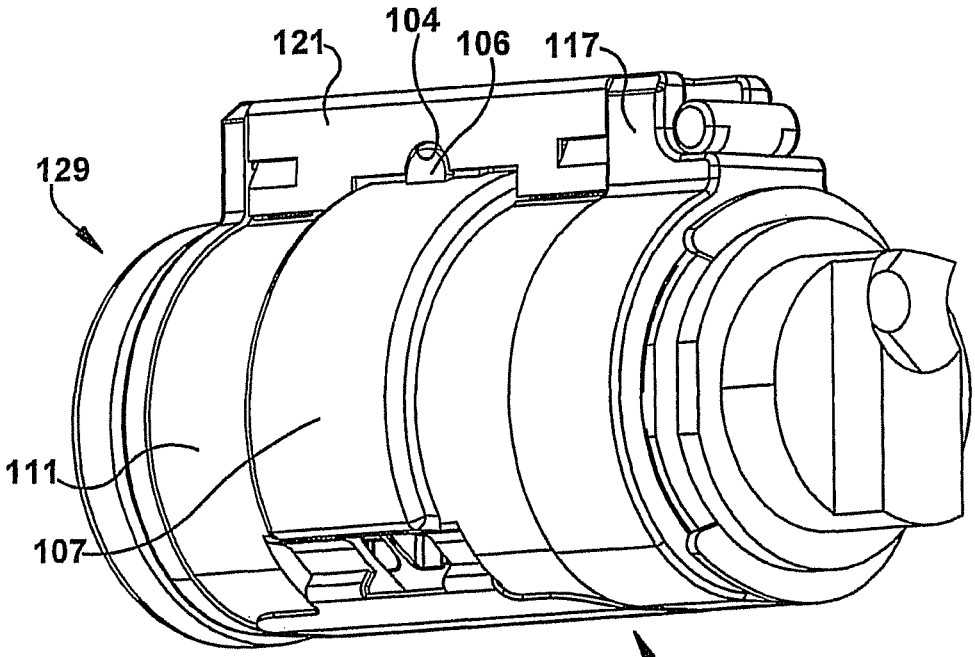
FIG. 4 illustrates a rear right perspective view of the recodeable key cylinder lock of FIG. 3.
Figure 5:
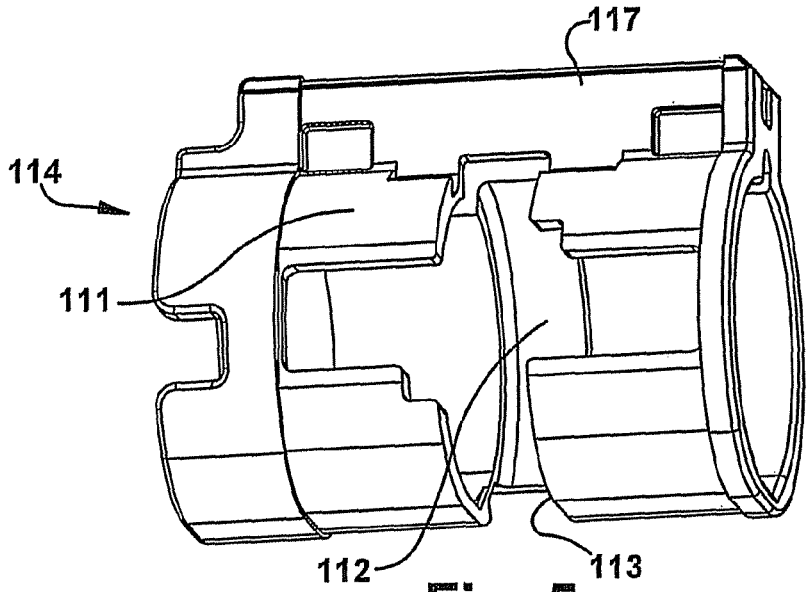
FIG. 5 illustrates a side perspective view of the cylinder housing of the recodeable key cylinder lock of FIG. 3.
Figure 6:
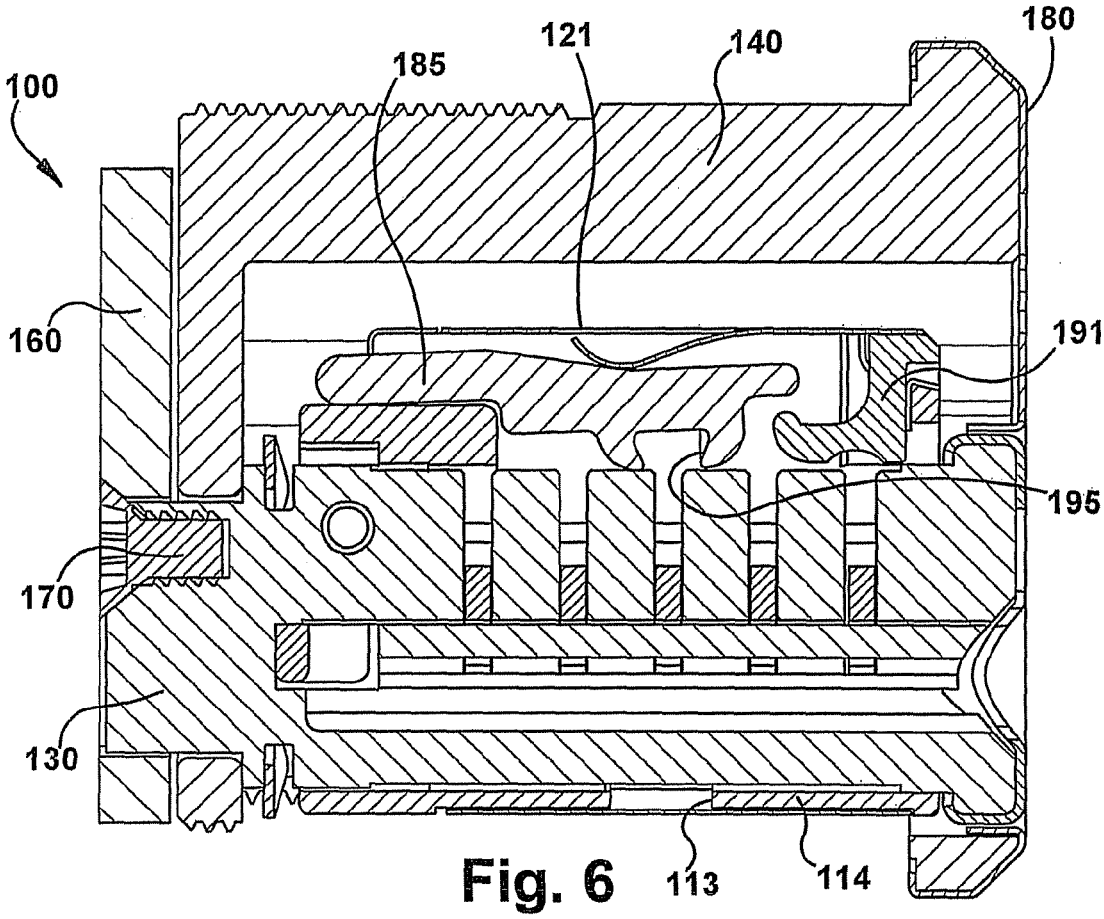
FIG. 6 illustrates a side cross-sectional view of the recodeable key cylinder lock of FIG. 3.
Figure 7:
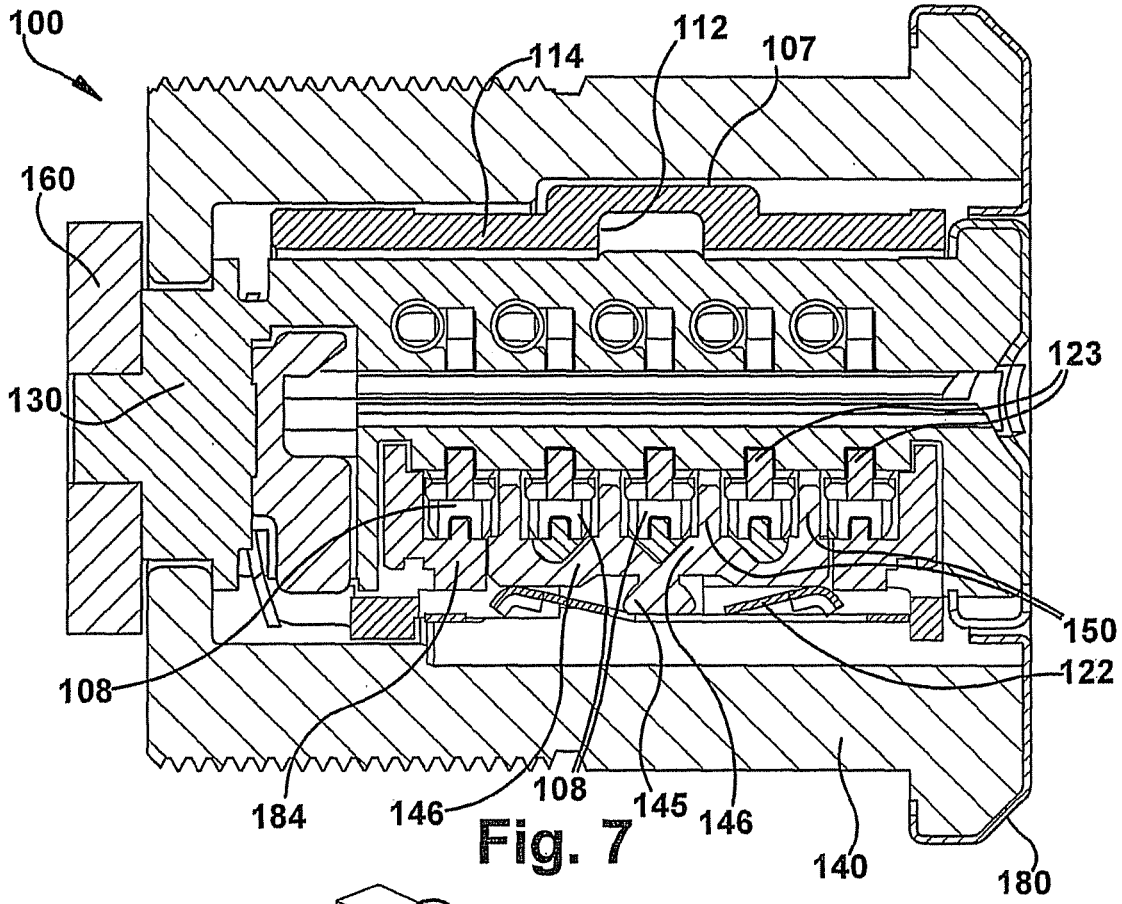
FIG. 7 illustrates a top cross-sectional view of the recodeable key cylinder lock of FIG. 3.
Figure 8:
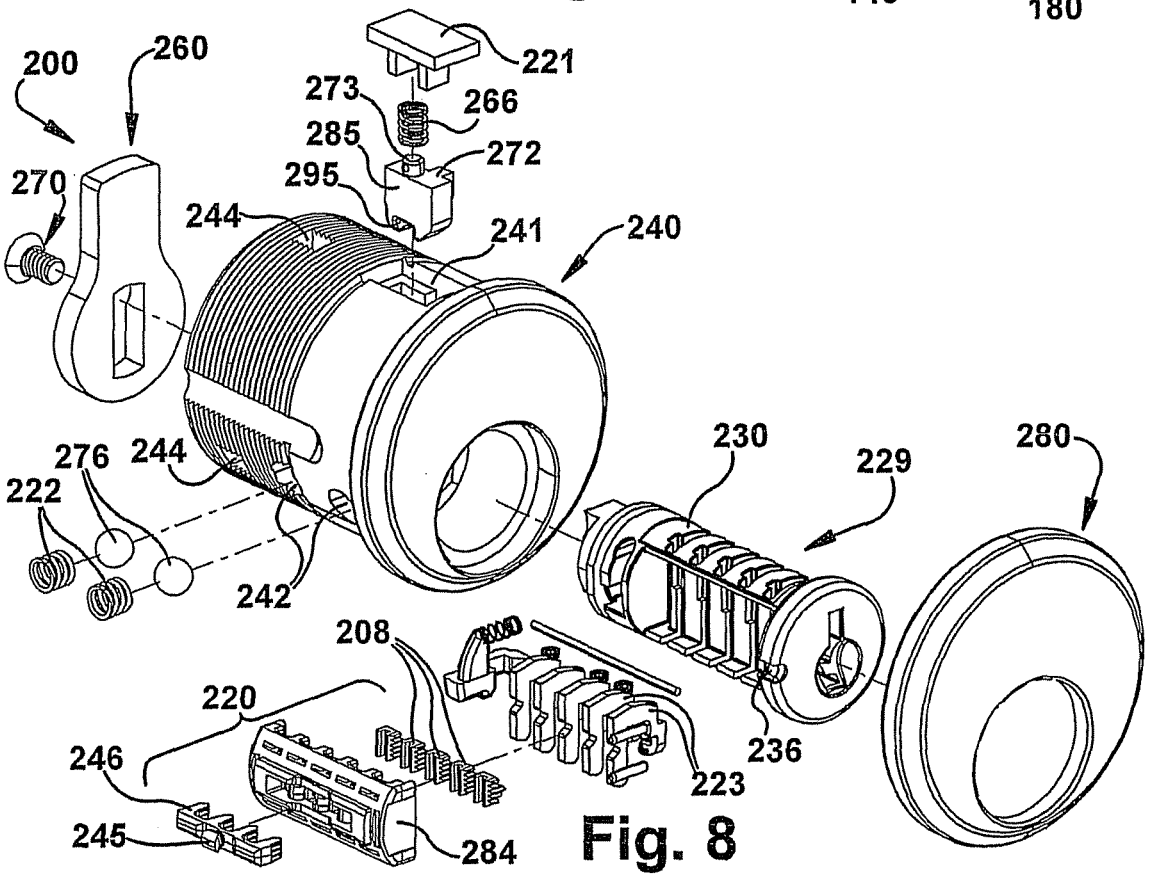
FIG. 8 illustrates an exploded front left perspective view of a recodeable key cylinder lock and mortise housing lock assembly.
Figure 9:
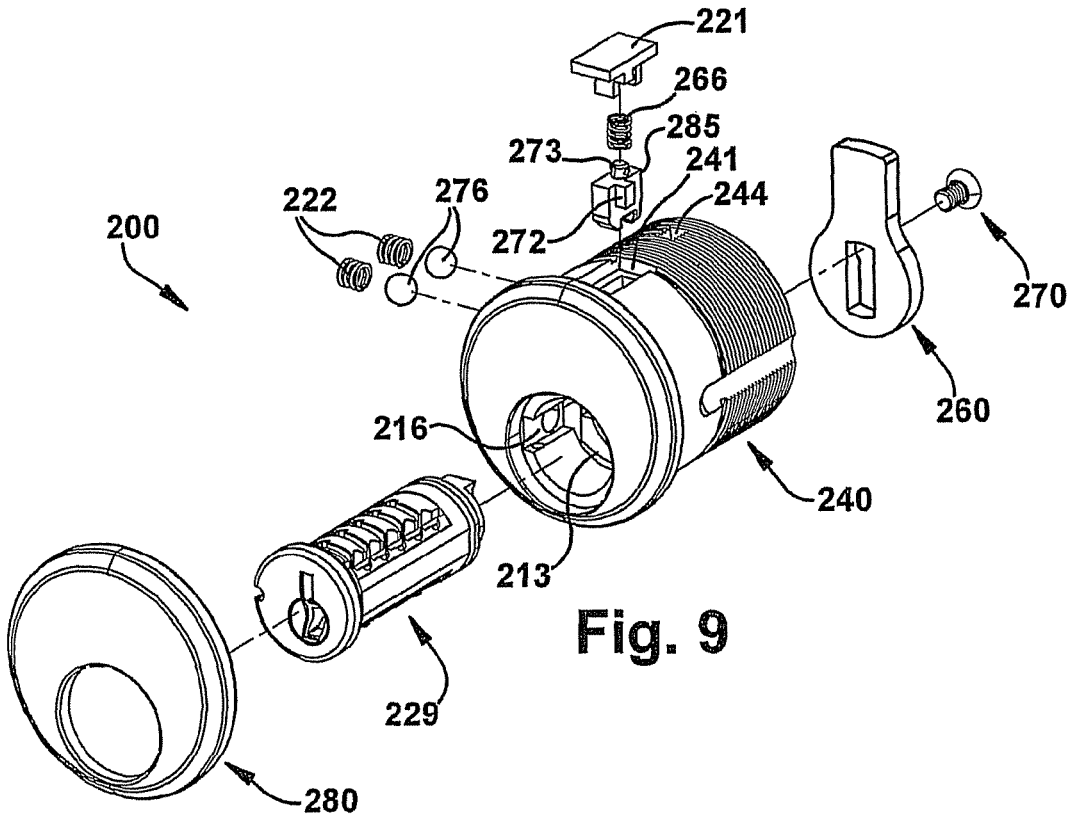
FIG. 9 illustrates an exploded front right perspective view of the lock assembly of FIG. 8.
Figure 10:
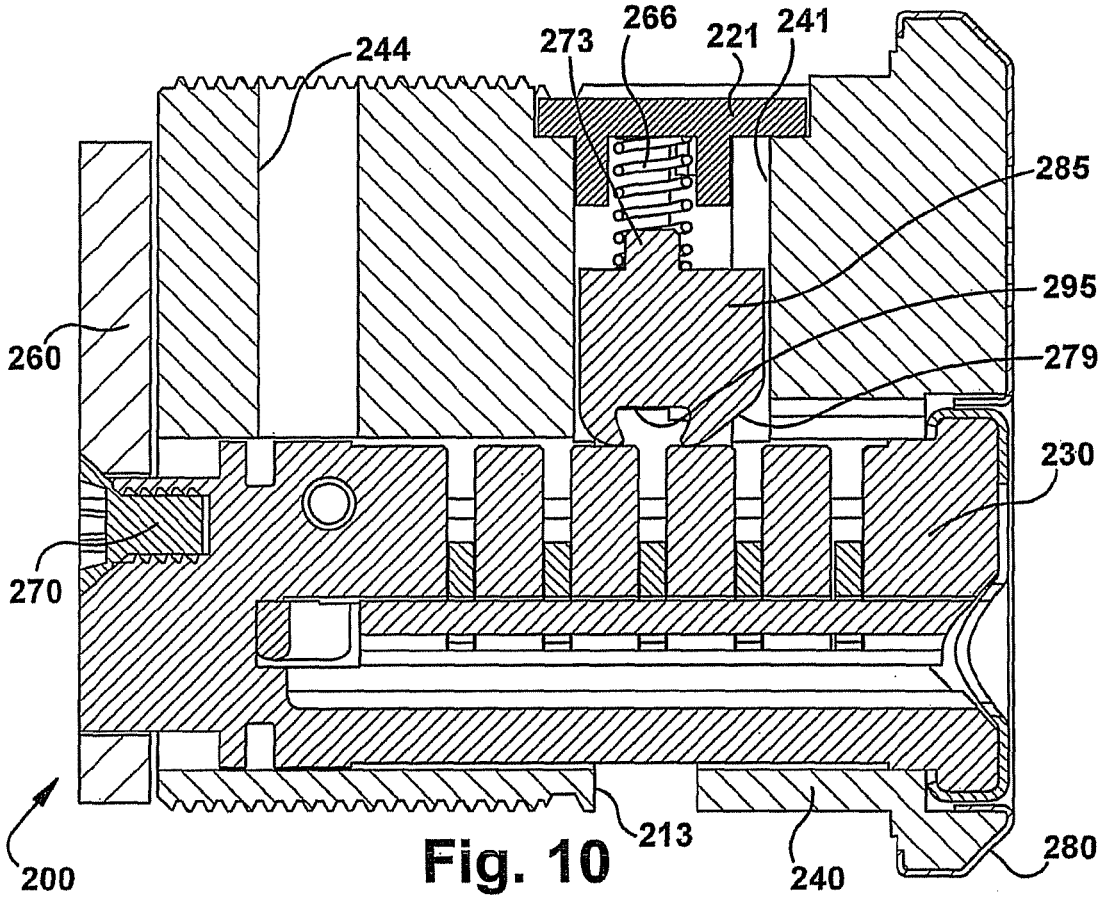
FIG. 10 illustrates a side cross-sectional view of the lock assembly of FIG. 8.
Figure 11:
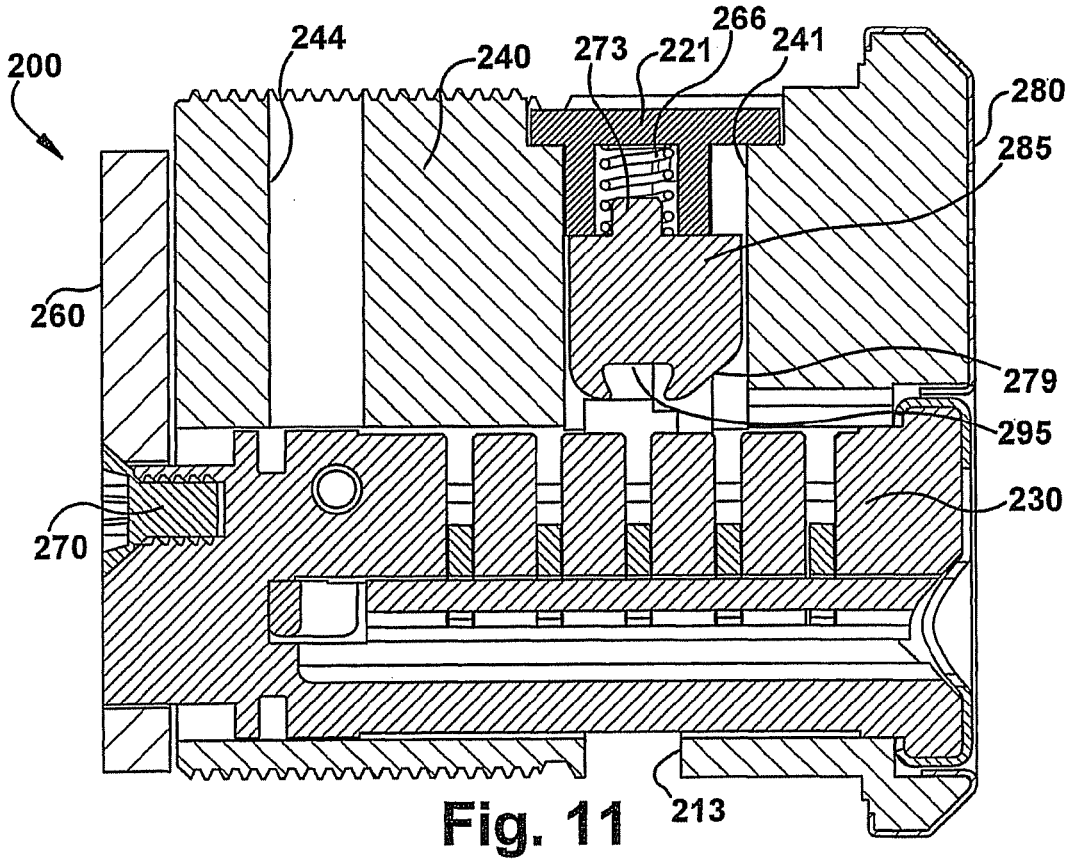
FIG. 11 illustrates another side cross sectional view of the lock assembly of FIG. 8.
Figure 12:
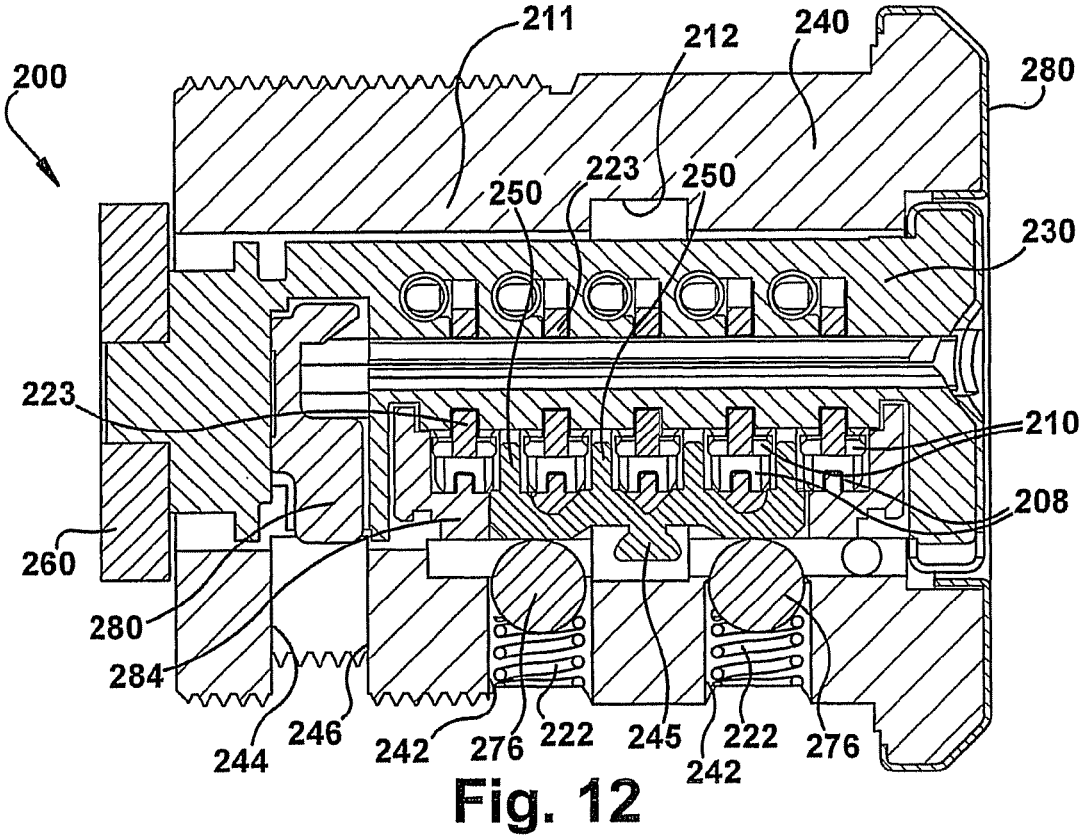
FIG. 12 illustrates a top cross-sectional view of the lock assembly of FIG. 8.

While the recodeable key cylinder arrangement may be provided in a variety of configurations, as shown in the illustrated embodiment, the arrangement may include some components that are consistent with the recodeable lock 929 of the '881 application. For example, as shown in FIGS. 2A-7, the locking mechanism 120 may include a sidebar 184 and a codebar 146 with an appendage 145 extending radially outward of the plug diameter to engage a catch 195 of a liftbar 185, such that the liftbar 185 may be operated (through a pivot lever 191) by an inserted tool to disengage codebar posts 150 (FIG. 7) from corresponding code blocks 108 to allow the positions of the code blocks 108 to be adjusted by the coded surface of a new key. A spring sleeve 122 may be provided around the cylinder plug 130 and sidebar 184 to bias the sidebar 184 and codebar 146 radially inward and out of engagement with the housing 114 when the code blocks 108 align with corresponding wafer tumblers 123 (FIG. 2B).

The recodeable cylinder lock 129 of FIGS. 2A-7 is shown assembled with a mortise housing 140, a cam 160 and screw 170, and a face plate 180, for installation, for example, in a residential or commercial entry door. The cam 160 may be operably connected to a latching arrangement, such as, for example, a door latch or deadbolt, such that rotation of the key cylinder moves the latching arrangement between locked and unlocked conditions. According to another inventive aspect of the present application, a recodeable key cylinder lock may be configured for direct assembly with a mortise housing, such that the cylinder may be provided without a separate cylinder housing (such as, for example, the cylinder housing 114 of the embodiment of FIGS. 2A-7). In one such embodiment, a mortise housing may be configured to allow for increased rotation (e.g., greater than 180.degree. rotation, or 360.degree. rotation) of the cylinder plug within the mortise housing upon insertion and rotation of an authorized key.

FIGS. 8-12 illustrate various views of an exemplary recodeable key cylinder and mortise housing locking arrangement 200 configured to allow for 360° rotation of the cylinder plug 230 within the mortise housing 240 upon insertion and rotation of an authorized key. The mortise housing 240 includes an axially extending notch 216 (FIG. 9) configured to receive a portion of a sidebar 284 (FIG. 12) assembled with the cylinder plug 230 to prevent rotation of the cylinder plug 230 in the locked condition. When an authorized key is inserted in the cylinder plug 230, the coded surface of the key (not shown) positions wafer tumblers 223 within the cylinder plug 230 to align with code blocks 208. In this aligned condition, the sidebar 284 is permitted to move radially inward to disengage the sidebar 284 from the mortise housing 240, thereby allowing the cylinder plug 230 and sidebar to rotate by turning the key.

The exemplary mortise housing 240 includes a circumferential wall 211 having an inner circumferential pocket or recess 212 sized and positioned to receive an appendage 245 of the codebar 246 extending radially outward of the cylinder plug diameter (defined by the cylinder plug 230 and the sidebar 284). This arrangement allows the appendage 245 to engage a liftbar 285 radially outward of the cylinder plug diameter, while allowing for rotation of the cylinder plug 230 and sidebar 284. The pocket 212 and the housing slot or channel 213 (FIGS. 10 and 11) together form a circumferential track around the entire circumference of the housing 214 to allow for 360° rotation of the cylinder plug 230 and sidebar 284, as they provide clearance for free, full rotation of the appendage 245.

While the recodeable key cylinder arrangement may be provided in a variety of configurations, as shown in the illustrated embodiment, the arrangement may include some components that are consistent with the recodeable lock 929 of the '881 application. For example, the illustrated locking mechanism 220 includes a sidebar 284 and a codebar 246 with an appendage 245 extending outward of the plug diameter, the codebar 246 also including posts 250 (FIG. 12) that are disengageable from corresponding code blocks 208 to allow the positions of the code blocks 208 to be adjusted by the coded surface of a new key. As another example, holes 244 may be provided in the mortise housing 240 to interlock with an anti-rotation block 280 provided with the cylinder plug 230 (FIG. 12), consistent with the anti-rotation block 980 of the '881 application, to ensure full insertion of the key during recoding. However, according to an inventive aspect of the present application, some components of a recodeable key cylinder locking arrangement may be modified for use with a cylinder plug assembled directly with a mortise housing (as opposed to a cylinder plug and cylinder housing assembled with a mortise housing). As an example of the limitations resulting from use with a cylinder housing, such as the cylinder housing 914 of the lock 929 of the '881 application, reduced size and wall thickness may limit the types of components provided outside the cylinder plug but within the housing, such as, for example, the spring member (sleeve 920) for biasing the sidebar 984 out of engagement with the cylinder housing 914, and the liftbar 985 and associated components for pulling the codebar 946 out of engagement with the code blocks 908.

Due to the additional wall thickness and space available in the larger mortise housing, some of these components may be modified, for example, to be more durable, more cost effective, and/or more simple (using fewer components). As one example, the mortise housing may be configured to retain a liftbar for engaging a portion of a codebar of a recodeable cylinder. In the illustrated embodiment of FIGS. 8-12, the mortise housing 240 includes a cavity 241 sized to retain a liftbar 285 and positioned to align a catch 295 of the liftbar with the codebar appendage 245 when the cylinder plug 230 and sidebar 284 are in a recoding orientation. To raise the liftbar 285 (and with it, the codebar 246) for recoding the lock (as described in greater detail above), the liftbar 285 may include a tapered tool engaging surface 279 (FIGS. 10 and 11) that aligns with a lock cylinder access hole 236 (FIG. 8) when the cylinder plug 230 and sidebar 284 are in a recoding orientation. When a tool is inserted in the access hole 236 and is axially pressed against the tool engaging surface 279, the resulting radial force raises the liftbar 285 and codebar 246 against spring member 266 to disengage the codebar posts 250 from the corresponding code blocks 208 for recoding the lock. As shown, a cover plate 221 may be staked into the cavity 241 to retain the liftbar 285 and spring member 266 within the mortise housing 240. The liftbar 285 may include a post 273 for aligning with the spring member 266 and a tab 272 to prevent installation of the liftbar 285 in the reverse orientation.

As shown, the use of a liftbar 285 configured to engage a tool directly may eliminate the need for a pivoting mechanism or an intermediate pivoting component, as are shown in the embodiment of FIGS. 2A-7 and in the lock 929 of the '881 application. Further, the additional wall thickness and space available in the mortise housing 240 allow for use of a conventional compression spring 266, which may be more readily available and may provide for more consistent spring biasing performance.

As another example of a modified component for use with the recodable key cylinder and mortise housing locking arrangement, the mortise housing may retain one or more spring loaded biasing members configured to bias the sidebar, when in the locked orientation, towards engagement with a series of wafer tumblers in the cylinder, such that proper positioning of the wafer tumblers (in response to insertion of an authorized key) allows the sidebar to be moved out of engagement with a locking portion of the mortise housing for rotation of the cylinder plug. In the illustrated embodiment, compression springs 222 and bearing members 276 disposed in holes or openings 242 in the mortise housing 240 bias the sidebar 284 and codebar 246 inward, thereby allowing the cylinder plug 230 and sidebar to rotate by turning the key. While plugs, fasteners or other such components may be installed in the openings 242 to retain the springs 222 and bearing members 276 in the mortise housing 240, in another embodiment, the openings 242 may be crimped or coined to retain the spring members and bearing members. While other suitably shaped bearing members may be used, the spherical shape of the illustrated bearing members 276 allows the sidebar 284 and codebar 246 to smoothly rotate into or out of engagement with the bearing members 276.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

We claim:

1. A recodeable lock comprising:

a housing;

a cylinder plug disposed within the housing;

a plurality of wafer tumblers disposed within the cylinder plug and movable within the cylinder plug in response to insertion of an authorized key into the cylinder plug;

a locking mechanism coupled with the cylinder plug, the locking mechanism comprising a plurality of code blocks, a sidebar, and a codebar releasably securing the plurality of code blocks to the sidebar, wherein insertion of the authorized key into the cylinder plug moves the plurality of wafer tumblers to a predetermined unlocking orientation, such that the plurality of code blocks permits disengagement of the sidebar from the housing for rotation of the cylinder plug and sidebar within the housing; and a liftbar disposed in the housing radially outward of the cylinder plug, the liftbar being configured to selectively engage a radially outward extending appendage of the codebar when the cylinder plug and sidebar are rotated to a recoding orientation, to release the plurality of code blocks from the sidebar;

wherein the housing comprises a unitary circumferential wall defining a circumferential track axially positioned to receive the appendage of the codebar to permit greater than 180 degree rotation of the cylinder plug and sidebar with respect to the housing, the circumferential track including a circumferential slot extending through the circumferential wall, and an circumferential pocket disposed on an inner surface of the circumferential wall and axially aligned with the slot.

2. The recodeable lock of claim 1, wherein the circumferential track is configured to permit 360 degree rotation of the cylinder plug and sidebar with respect to the housing.

3. The recodeable lock of claim 1, wherein the housing comprises an outer peripheral rib of material axially and circumferentially aligned with the pocket.

4. The recodeable lock of claim 1, wherein the housing comprises a mortise housing, the circumferential track being integral with the mortise housing.

5. The recodeable lock of claim 1, further comprising a spring loaded biasing member disposed in a radially extending hole in the housing for biasing the sidebar towards disengagement from the housing.

6. The recodeable lock of claim 1, wherein the liftbar comprises a catch member radially slideable in an aperture in the housing for movement of the codebar out of engagement with the plurality of code blocks.

7. The recodeable lock of claim 1, wherein the liftbar includes a tapered surface positioned to engage a tool inserted in an opening in the lock to direct an axial force applied by the tool to effect radial movement of the liftbar.

8. The recodeable lock of claim 1, wherein each of the plurality of code blocks engages a corresponding one of the plurality of wafer tumblers.

9. A recodeable lock comprising:

a housing;

a cylinder plug disposed within the housing;

a plurality of wafer tumblers disposed within the cylinder plug and movable within the cylinder plug in response to insertion of an authorized key into the cylinder plug;

a locking mechanism coupled with the cylinder plug, the locking mechanism comprising a plurality of code blocks, a sidebar, and a codebar releasably securing the plurality of code blocks to the sidebar, wherein insertion of the authorized key into the cylinder plug moves the plurality of wafer tumblers to a predetermined unlocking orientation, such that the plurality of code blocks permits disengagement of the sidebar from the housing for rotation of the cylinder plug and sidebar within the housing; and a liftbar disposed in the housing radially outward of the cylinder plug, the liftbar being configured to selectively engage a radially outward extending appendage of the codebar when the cylinder plug and sidebar are rotated to a recoding orientation, an entirety of the liftbar further being radially slideable within an aperture in the housing to release the plurality of code blocks from the sidebar.

10. The recodeable lock of claim 9, wherein the liftbar includes a tapered surface positioned to engage a tool inserted in an opening in the lock to direct an axial force applied by the tool to effect radial movement of the liftbar.

11. The recodeable lock of claim 9, wherein the housing comprises a circumferential track axially positioned to receive the appendage of the codebar to permit 360 degree rotation of the cylinder plug and sidebar with respect to the housing.

12. The recodeable lock of claim 11, wherein the housing comprises a mortise housing, the circumferential track being integral with the mortise housing.

13. The recodeable lock of claim 9, wherein the housing comprises a mortise housing, the housing aperture being integral with the mortise housing.

14. The recodeable lock of claim 9, further comprising a spring loaded biasing member disposed in a radially extending hole in the housing for biasing the sidebar towards disengagement from the housing.

15. A recodeable lock comprising:

a housing;

a cylinder plug disposed within the housing;

a plurality of wafer tumblers disposed within the cylinder plug and movable within the cylinder plug in response to insertion of an authorized key into the cylinder plug;

a locking mechanism coupled with the cylinder plug, the locking mechanism comprising a plurality of code blocks, a sidebar, and a codebar releasably securing the plurality of code blocks to the sidebar, wherein insertion of the authorized key into the cylinder plug moves the plurality of wafer tumblers to a predetermined unlocking orientation, such that the plurality of code blocks permits disengagement of the sidebar from the housing for rotation of the cylinder plug and sidebar within the housing;

a spring loaded biasing member disposed in a radially extending hole in the housing for biasing the sidebar radially inward towards disengagement from the housing; and a liftbar disposed in the housing radially outward of the cylinder plug, the liftbar being configured to selectively engage a radially outward extending appendage of the codebar when the cylinder plug and sidebar are rotated to a recoding orientation, to release the plurality of code blocks from the sidebar.

16. The recodeable lock of claim 15, wherein the housing comprises a circumferential track axially positioned to receive the appendage of the codebar to permit 360 degree rotation of the cylinder plug and sidebar with respect to the housing.

17. The recodeable lock of claim 15, wherein the housing comprises a mortise housing, the hole of the housing being integral with the mortise housing.

18. The recodeable lock of claim 15, wherein the spring loaded biasing member comprises a ball bearing and compression spring.

* * * * *